US009995505B2

(12) United States Patent
Giaretta et al.

(10) Patent No.: US 9,995,505 B2
(45) Date of Patent: Jun. 12, 2018

(54) TRANSPORTABLE AIR HEATER

(71) Applicant: MCS ITALY S.p.A., Pastrengo (IT)

(72) Inventors: Enzo Giaretta, Pastrengo (IT); Francesco Sembenini, Pastrengo (IT); Alberto Meneghini, Pastrengo (IT)

(73) Assignee: MCS ITALY, S.P.A., Verona (IT)

( * ) Notice: Subject to any disclaimer, the term of this patent is extended or adjusted under 35 U.S.C. 154(b) by 340 days.

(21) Appl. No.: 14/977,758

(22) Filed: Dec. 22, 2015

(65) Prior Publication Data

US 2016/0178237 A1 Jun. 23, 2016

(30) Foreign Application Priority Data

Dec. 22, 2014 (IT) ..... MI2014A2208

(51) Int. Cl.

| | |
|---|---|
| ***F24H 3/08*** | (2006.01) |
| ***F24H 3/06*** | (2006.01) |
| ***F24H 9/00*** | (2006.01) |
| *F24H 3/04* | (2006.01) |

(52) U.S. Cl.

CPC ..... *F24H 3/087* (2013.01); *F24H 3/065* (2013.01); *F24H 9/0063* (2013.01); *F24H 9/0068* (2013.01); *F24H 3/0417* (2013.01)

(58) Field of Classification Search

CPC ..... F24H 3/087; F24H 3/065; F24H 9/0063; F24H 9/0068; F24H 3/0417

See application file for complete search history.

(56) References Cited

U.S. PATENT DOCUMENTS

| | | | | |
|---|---|---|---|---|
| 3,252,497 A * | 5/1966 | McGillis | ..... | F23D 11/08 126/95 |
| 4,203,415 A | 5/1980 | Gruber | | |
| 2004/0103892 A1 * | 6/2004 | Shimonoma | ..... | F24H 3/04 126/110 D |

FOREIGN PATENT DOCUMENTS

| | | |
|---|---|---|
| DE | 9002588 | 5/1990 |
| EP | 0331969 | 9/1989 |

OTHER PUBLICATIONS

Italian Search Report for No. IT MI20142208, dated Sep. 4, 2015, Munich, 9 pages.

* cited by examiner

*Primary Examiner* — Alfred Basichas
(74) *Attorney, Agent, or Firm* — Thomas Horstemeyer, LLP

(57) ABSTRACT

A transportable combustion air heater comprises a transportable supporting frame, a housing fixed to the frame, a cylindrical combustion chamber arranged in housing, a cylindrical annular thermal exchange channel formed around the combustion chamber, an external heating chamber defining an annular fume channel around the thermal exchange channel, in which one or more transversal guide walls are arranged in the external heating chamber, which guide walls lengthen flow paths of the fumes in the annular fume channel from fume inlet openings to an exhaust fume opening.

11 Claims, 5 Drawing Sheets

Figure 1:
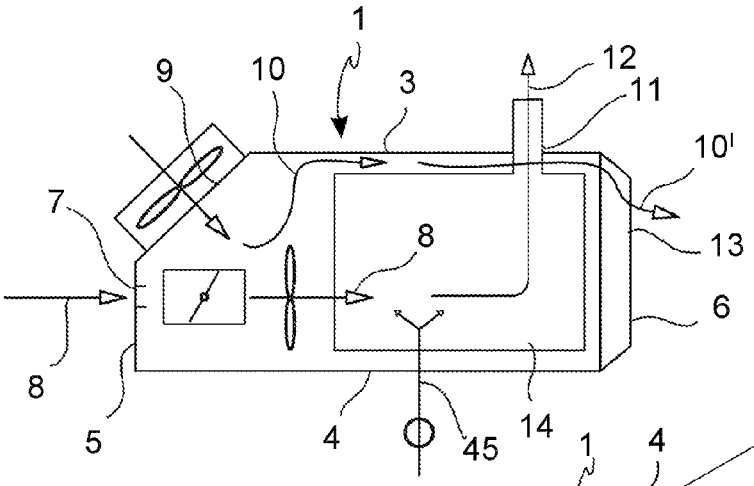

FIG. 11
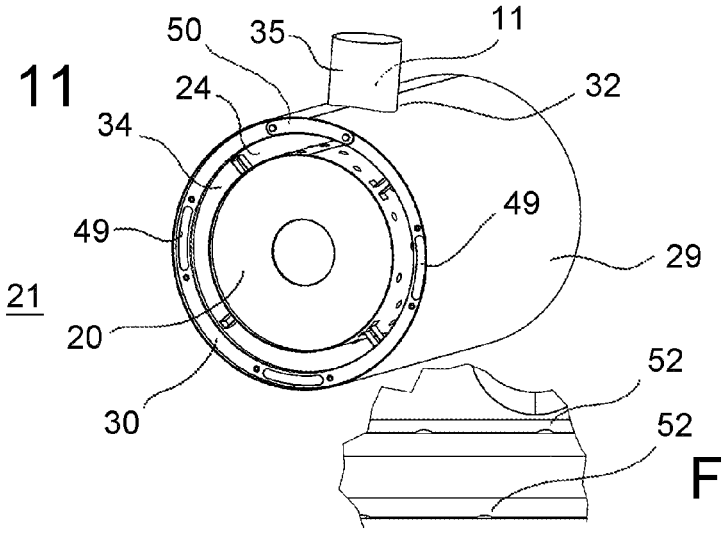
FIG. 12
FIG. 13
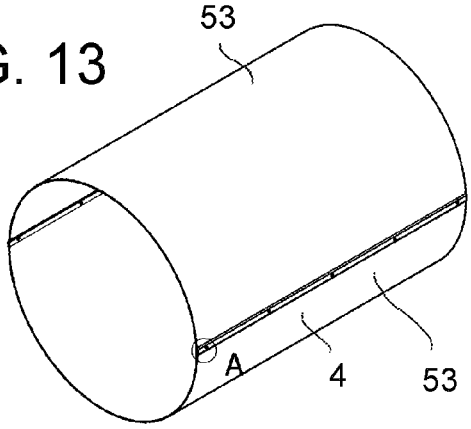
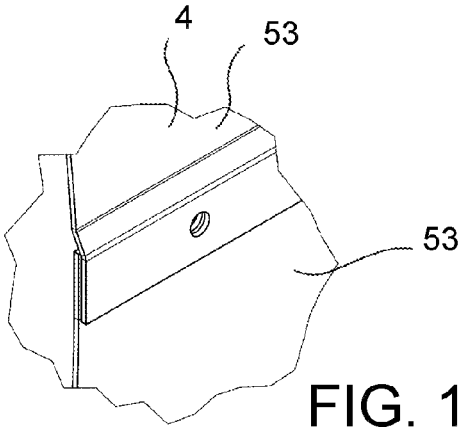
FIG. 14
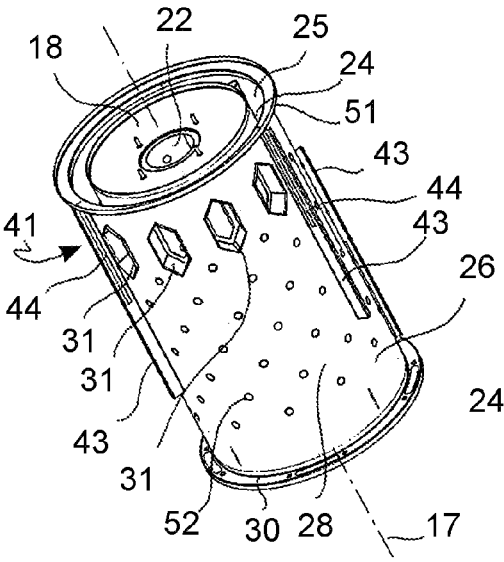
FIG. 15
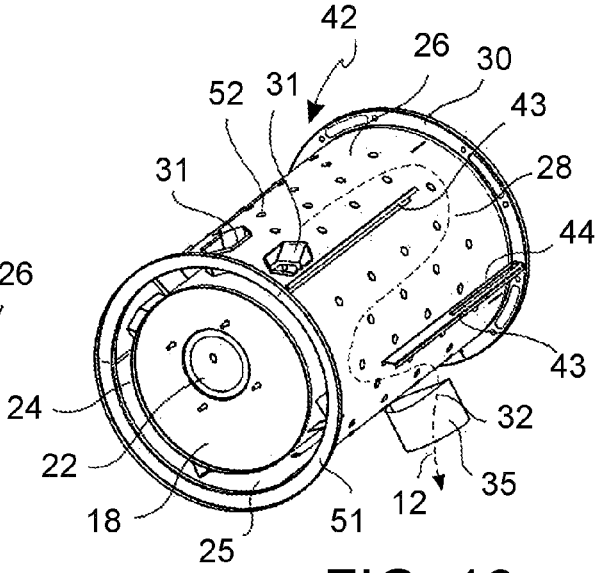
FIG. 16

TRANSPORTABLE AIR HEATER

CROSS-REFERENCE TO RELATED APPLICATION

This application claims the benefit of and priority to Italian patent application number MI2014A002208, filed on Dec. 12, 2014, the entirety of which is hereby incorporated by reference.

The present invention relates to a transportable air heater, in particular to a transportable combustion heater which can be used in very different ambient conditions, for example in work sites, mines, industrial warehouses, and also in temporary or permanent civil and military installations.

Transportable liquid or gas fuel heaters are known for heating air, with a combustion chamber, a fuel supply device which dispenses a liquid fuel into the combustion chamber, a first air conveyor which introduces combustion air into the combustion chamber, an annular thermal exchange chamber formed in relation to thermal exchange around the combustion chamber, and a second air conveyor which conveys the ambient air through the thermal exchange chamber to heat the ambient air. In order to allow the installation and transport of the heater, it is also known to mount all the components thereof on a transportable supporting structure, for example a carriage that can be towed on the road.

The nature of the typical applications (work sites, mines, large areas in remote locations and in difficult climate and ambient conditions, high production of heat) of these heaters has favored the aspects of reliability and structural sturdiness to the detriment of other functional features to date considered secondary and not deserving of particular attention, such as in particular the overall heat efficiency of combustion and thermal exchange, the noisiness, vibrations and accordingly, the weight, dimensions and operating costs.

With the ever increasing attention paid to operating in an economically and ecologically sustainable manner, there is a need for improving large-sized and high thermal power heaters, also with reference to the aforesaid "secondary" functional aspects, while obviously ensuring the reliability and sturdiness thereof.

It is therefore the object of the present invention to improve a heater of the type specified above, with reference to the energy efficiency of combustion and thermal exchange and, secondarily, also concerning the operating costs, noisiness, vibrations, weight and dimensions.

According to an approach of the invention, at least part of the objects of the invention can be achieved by modifying the fluid-dynamic behavior, with particular reference to the flow of the combustion fumes, and the conditions of thermal exchange between the combustion fumes and the ambient air, so as to increase the time, the pathway and the surface of the thermal exchange without however generating an excessive counterpressure when the fumes are exhausted, which would jeopardize the stability of the combustion.

According to a further approach of the invention, at least a part of the objects can be achieved by isolating the combustion and thermal exchange unit from the outer housing in an effective and space-saving manner.

At least part of the objects of the invention is achieved by means of a heater according to claim 1. The dependent claims relate to advantageous and preferred embodiments of the invention.

Figure 2:
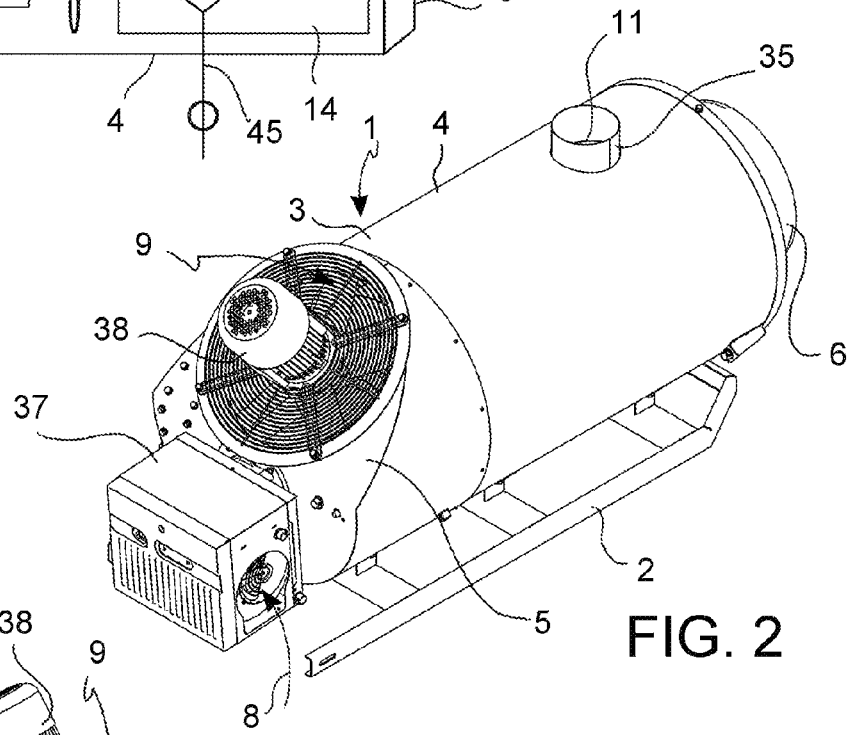
Figure 3:
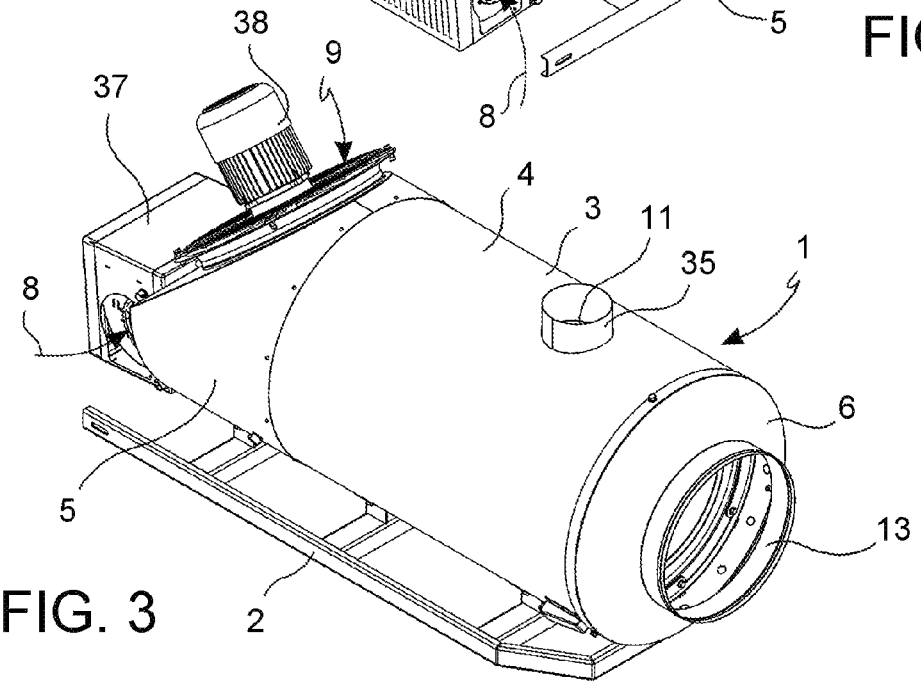
Figure 4:
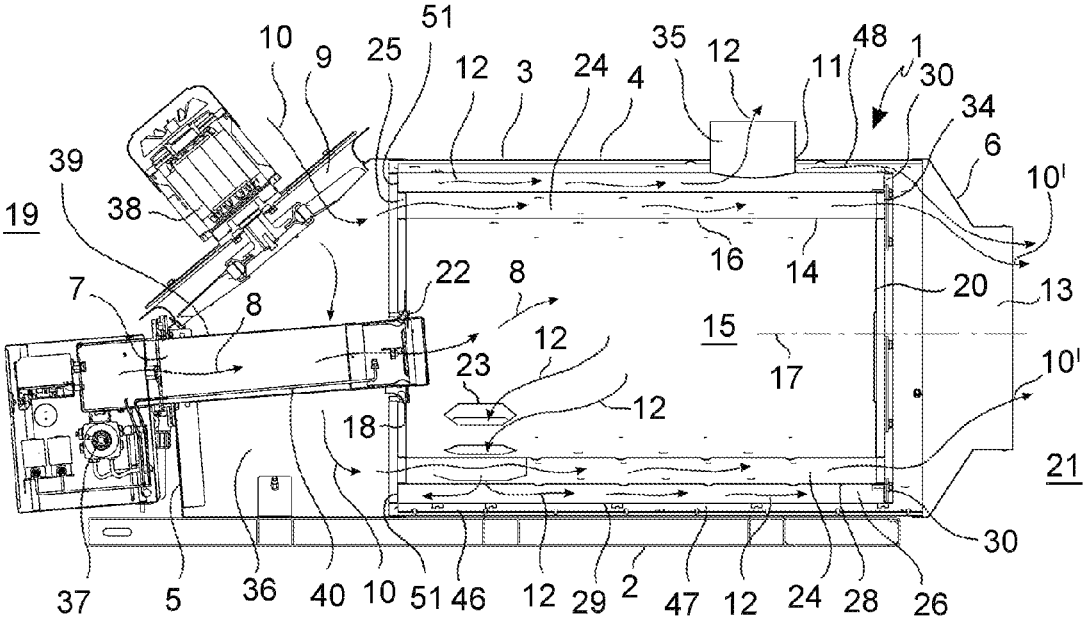
Figure 5:
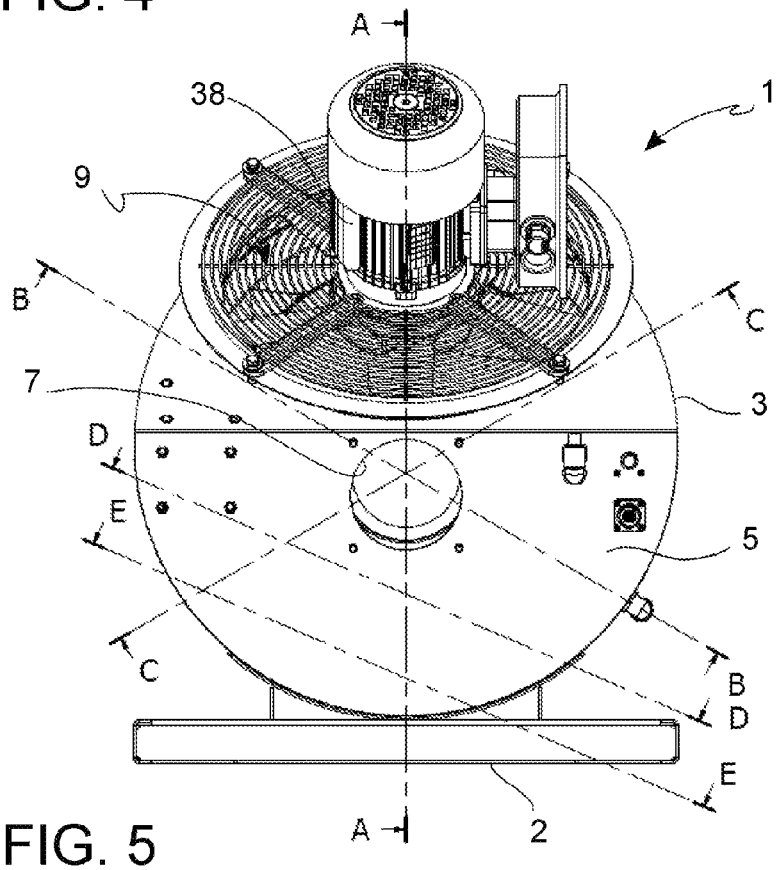
Figure 6:
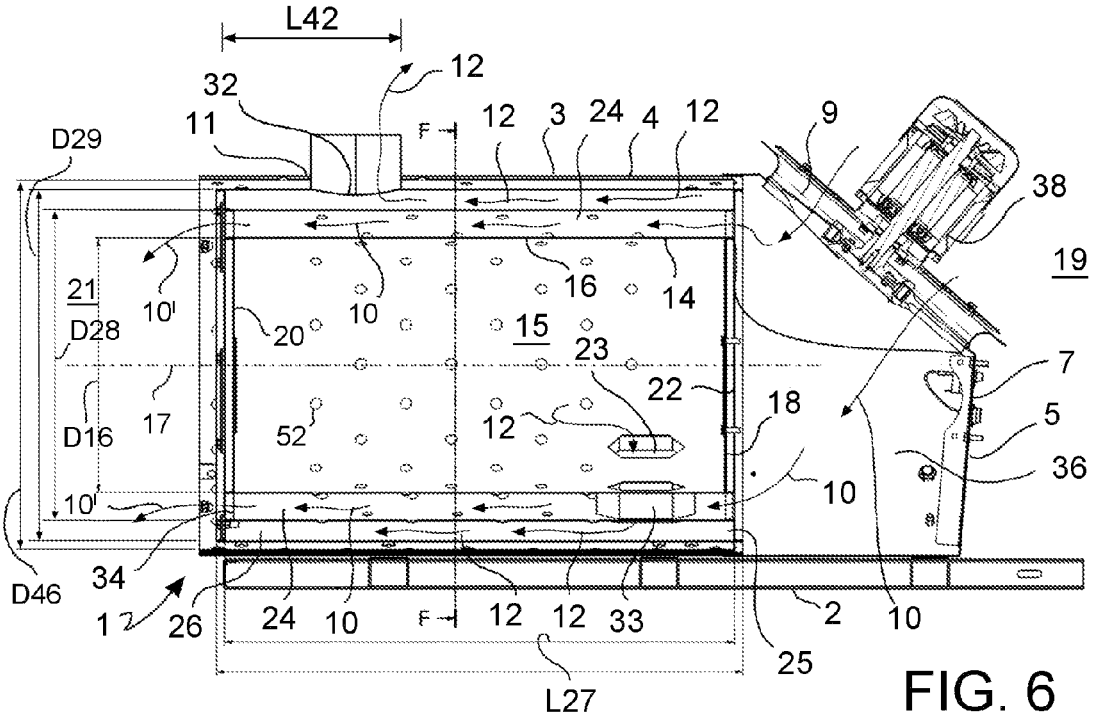
Figure 7:
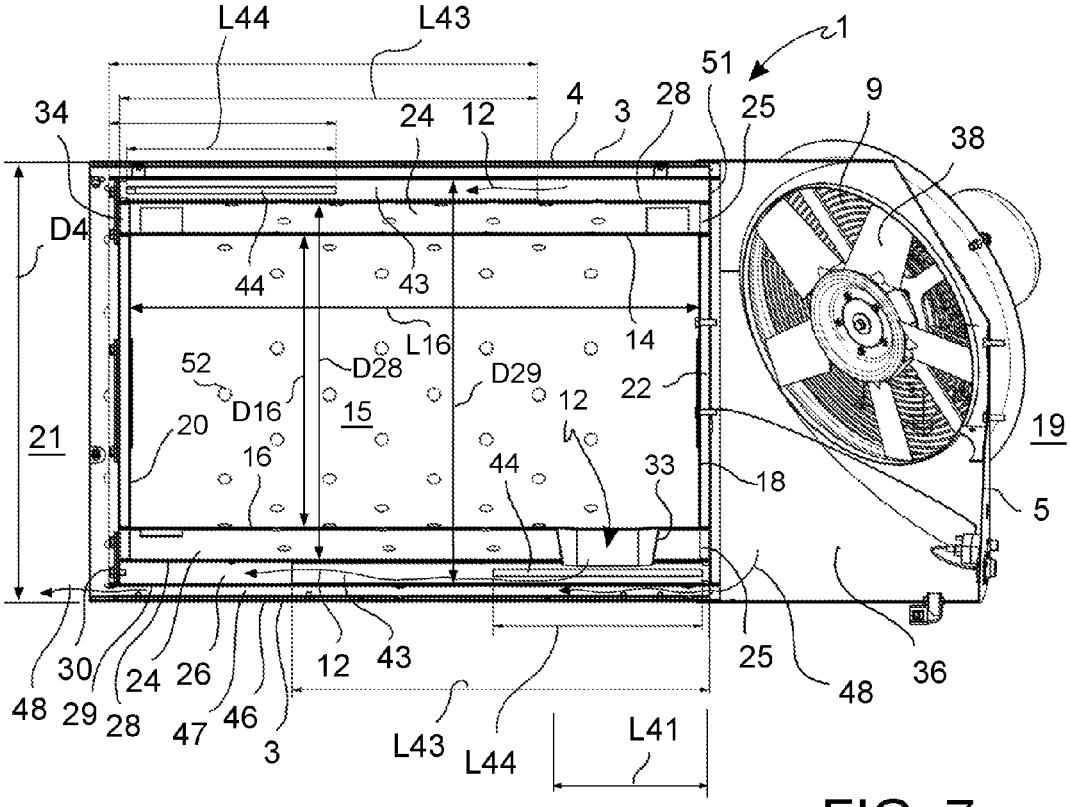
Figure 8:
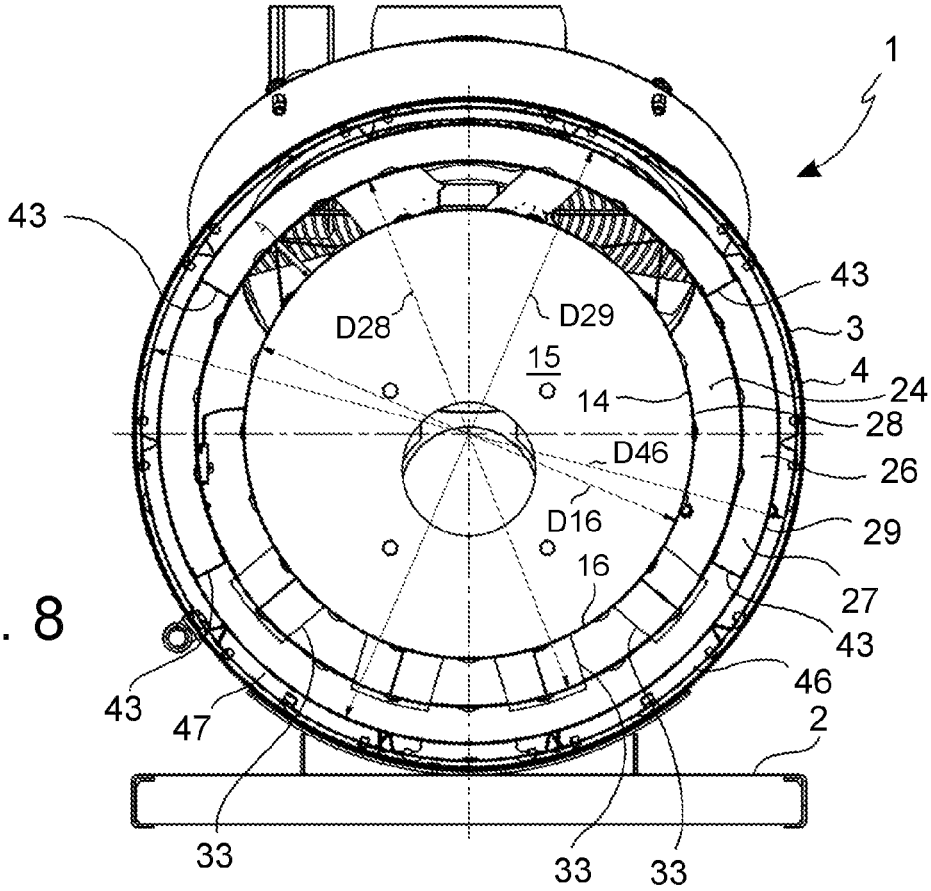
Figure 9:
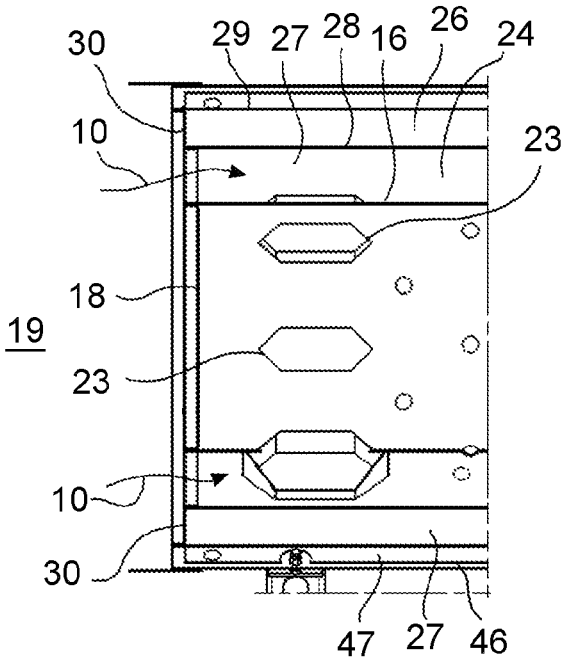
Figure 10:
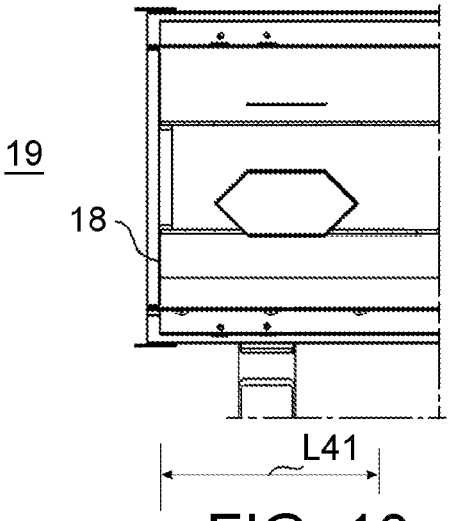

The features and advantages of the present invention will become apparent from the description of preferred embodiments thereof, given only by way of non-limiting, indicative example, with reference to the drawings, in which:

FIG. 1 is a diagram which shows the operating principle of a combustion heater for heating air, FIGS. 2 and 3 are perspective views of a combustion heater for heating air in accordance with an embodiment of the invention;

FIG. 4 is a sectional view in a vertical-longitudinal plane of the combustion heater for heating air in FIGS. 1 and 2, FIG. 5 is a rear view of the combustion heater for heating air in FIGS. 1 and 2, FIG. 6 is a sectional view of the combustion heater according to the plane A-A in FIG. 5, FIG. 7 is a sectional view of the combustion heater according to the plane B-B in FIG. 5, FIG. 8 is a sectional view of the combustion heater according to the vertical-transversal section plane, FIG. 9 is a partial sectional view of the combustion heater according to the plane D-D in FIG. 5, FIG. 10 is a sectional view of the combustion heater according to the plane E-E in FIG. 5, FIG. 11 is a perspective view of a burner-heat exchanger unit of the heater according to an embodiment, FIG. 12 shows a detail of the burner-heat exchanger unit of the heater according to an embodiment, FIG. 13 is a perspective view of a side wall of the housing of the heater according to an embodiment, FIG. 14 shows a detail of the side wall in FIG. 13, FIGS. 15 and 16 are perspective views of an external heating chamber of the combustion heater according to an embodiment.

With reference to the drawings, a transportable combustion air heater 1 comprises:

A) a transportable supporting frame 2 (possibly equipped with wheels),

B) a housing 3 made of steel sheet fixed to frame 2 and having:

- a substantially cylindrical side wall 4, a rear wall 5 and a front wall 6 opposite the rear wall 5,
- a first pathway 7 for the inlet of combustion air 8 and a second pathway 9 for the inlet of ambient air 10 to be heated, which are formed in the rear wall 5,
- a third pathway 11 formed in the side wall 4 for the outlet of fumes and combustion gases 12,
- a fourth pathway 13 formed in the front wall 6 for the outlet of the heated ambient air 10', C) a cylindrical combustion chamber 14 made of steel sheet fixedly arranged in housing 3 and internally defining a combustion space 15, said combustion chamber 14 having:

- a cylindrical side wall 16 concentric to a longitudinal axis 17 of heater 1, a rear wall 18 closing the combustion chamber 14 on a rear side 19, and a front wall 20 without openings which closes the combustion chamber 14 on a front side 21,
- an inlet opening 22 formed in the rear wall 18 for the incoming combustion air 8,
- a plurality of fume outlet openings 23 spaced from each other and formed in the side wall 16, D) a cylindrical annular thermal exchange channel 24 formed around the combustion space 15 and defined by the side wall 16 of the combustion chamber 14 and by a first cylindrical wall 28 outwardly extended around the side wall 16 of the combustion chamber 14, the thermal exchange channel 24 having:

- a rear annular opening 25 extended around the combustion chamber 14 for the incoming ambient air 10 to be heated, a front annular opening 34 extended around the combustion chamber 14 for the outgoing heated ambient air 10', E) an external heating chamber 26 made of steel sheet fixedly arranged in the housing 3, in which said external heating chamber 26 forms a cylindrical annular fume channel 27 around the thermal exchange channel 24 and comprises:

the first cylindrical wall 28 and a second cylindrical wall 29 outwardly extended around the first cylindrical wall 28, an annular front wall 30 and an annular rear wall 51 closing the fume channel 27 on the front 21 and rear 19 sides, a plurality of fume inlet openings 31 spaced from each other and formed in the first cylindrical wall 28, an exhaust fume opening 32 formed in the second cylindrical wall 29 and aligned with the third pathway 11 in the side wall 4 of housing 3, fume pipes 33 which connect each of the fume outlet openings 23 of the combustion chamber 14 to one of the fume inlet openings 31, respectively, of the external heating chamber 26, to cause the combustion fumes 12 to flow from the combustion space 15 into the annular fume channel 27, thereby keeping the fumes 12 separated from the ambient air flow 10 in the thermal exchange channel 24, F) an exhaust fume pipe 35 extended from the exhaust fume opening 32 of the external heating chamber 26 up to or through the third pathway 11 of housing 3 for exhausting the exhausted fumes from the annular fume channel 27 to the outside of heater 1, G) an air distribution space 36 defined by housing 3 and by the front walls 20, 30 of the combustion chamber 14 and of the external heating chamber 26, a first fan 37 fixed to the rear wall 5 of housing 3 at the first pathway 7 to blow the combustion air 8 into the combustion chamber 14, a second fan 38 fixed to the rear wall 5 of housing 3 at the second pathway 9 to channel the ambient air to be heated 10 through the air distribution space 36 into the thermal exchange channel 24, an air feeding pipe 39 extended from the first fan 37 through the air distribution space 36 to the inlet opening 22 of the combustion chamber 14, such as to isolate the combustion air flow 8 from the ambient air to be heated 10, a fuel feeder 40 configured to feed a liquid fuel, for example diesel fuel, into the combustion chamber 14, According to an aspect of the invention, the fume inlet openings 31 lead into a first end portion 41 of the annular fume channel 27 and the exhaust fume opening 32 is formed in a second end portion 42 of the annular fume channel 27, opposite to the first end portion 41, in which the first end portion 41 has a longitudinal extension L41 which is less than one third of the whole longitudinal length L27 of the annular fume channel 27 and the second end portion 42 has a longitudinal extension L42 which is less than half of the whole longitudinal length L27 of the annular fume channel 27. Moreover, one or more guide walls 43 are arranged in the external heating chamber, which guide walls 43 are transversal to the first and second cylindrical walls 28, 29, which lengthen the fume flow paths 12 in the annular fume channel 27 from the fume inlet openings 31 to the exhaust fume opening 32.

Heater 1 thus configured allows a thermal exchange between the combustion fumes 12 and the air to be heated 10 in two cylindrical interfaces (side wall 16 of the combustion chamber 14 and first cylindrical wall 28) and with a better distribution and increased permanence of the still hot fumes along the outer thermal exchange interface formed by the first cylindrical wall 28.

In accordance with an embodiment, the guide walls 43 can comprise windows 44, for example narrow, elongated slots, to cause a portion of the fumes 12 to flow directly through the guide walls 43 rather than guiding them along it, to avoid the occurrence of excessive counterpressures (resistance to the flow) in particular operating conditions of heater 1, for example having reduced thermal power with reduced flow rate of fuel 45 and combustion air 8.

According to an embodiment, the guide walls 43 comprise a first group of (preferably two) guide walls spaced from each other in circumferential direction (relative to the longitudinal axis 17) and running in longitudinal direction (parallel to the longitudinal axis 17) from a front end of the annular fume channel 27 towards an opposite rear end thereof, and a second group of (preferably two) guide walls spaced from each other in a circumferential direction (relative to the longitudinal axis 17) and running in a longitudinal direction (parallel to the longitudinal axis 17) from the rear end of the annular fume channel 27 towards the front end thereof, in which the guide walls 43 of the first group overlap or alternate with the guide walls 43 of the second group, thus defining a fume flow path having an undulated shape from the fume inlet openings 31 to the exhaust fume opening 32. Preferably, the guide walls 43 lie on planes radial to the longitudinal axis 17 and have an axial length L43 ranging from 60% to 80%, preferably of about 70%, of the total axial length L27 of the fume channel 27, thus ensuring a distribution of the hot fumes along the whole thermal exchange area of the first cylindrical wall 28.

The windows 44 are formed in the guide walls 43 of the second group at the position of the fume inlet openings 31 and extend in axial direction along the whole region of the first cylindrical wall 28 in which the fume inlet openings 31 are formed. Preferably, the axial length L44 (parallel to the longitudinal axis 17) of the windows 44 ranges from 40% to 60%, preferably is about 50% of the axial length L43 of the corresponding guide wall 43.

Advantageously, the fume inlet openings 31 are formed in an area circumferentially opposite (and preferably, but not necessarily, also axially opposite) to the area where the exhaust fume opening 32 is formed and the guide walls 43 are positioned between the fume inlet 31 and the exhaust fume 32 openings in such a manner as to define a complete wave path, i.e. with two opposed bends, between such openings 31, 32 (FIG. 16).

According to a further aspect of the invention, the sum of the areas of opening section of the fume outlet openings 23 ranges between 1/40 (=2.5%) and 1/60 (=1.67%), preferably between 1/50 (=2%) and 1/60 (=1.67%), even more preferably approximately 1/54 (=1.85%) of the total area of the cylindrical side wall 16 (including the area of the fume outlet openings 23) of the combustion chamber 14, while the opening section area of the single fume outlet opening 23, considered individually, can be advantageously less than 100 $cm^2$, preferably less than 75 $cm^2$, even more preferably approximately 45 . . . 55 $cm^2$.

Thus, the fume outlet openings 23 result in a constriction of the flow outlet from the combustion chamber 14 which creates a counterpressure such as to promote a complete distribution and sufficient permanence of the hot fumes along the whole side wall 16 of the combustion chamber 14, i.e. on the inner thermal exchange interface. Moreover, the total pathway area of the fume outlet openings 23 ensures both the stability and reliability of combustion and a sufficient heating of the first cylindrical wall 28 which forms the outer thermal exchange interface.

In accordance with a further aspect of the invention, heater 1 comprises a layer 46 of heat-reflecting material, in particular an aluminized sheet, formed around the second cylindrical wall 29 of the external heating chamber 26 such as to provide a first thermal isolation barrier with respect to housing 3. The layer 46 of heat-reflecting material is preferably circular cylindrical and coaxial with the longitudinal axis 17 of heater 1. The aluminized sheet can comprise a base metal layer, e.g. steel, and an aluminum coating which automatically forms an outer layer of aluminum oxide ($Al_2O_3$) called alumina and is very heat-resistant but also heat-reflecting. The aluminized sheet forms the aforesaid heat-reflecting layer 46 with the surface of the alumina facing radially inwards.

Alternatively or additionally, an annular interstice 47 can be provided, which is formed:

between the second cylindrical wall 29 and the layer 46 of heat-reflecting material and the side wall 4 of housing 3, and/or between the second cylindrical wall 29 and the layer 46 of heat-reflecting material, through which interstice 47 a cooling flow 48 (FIG. 4) is passed which is separated from the ambient air flow to be heated 10, such as to realize a (second) cooling barrier.

The first barrier reduces heat losses by means of thermal isolation and heat retro-reflection, while the second barrier disperses residual heat to obviate the overheating of housing 3, and brings the extracted heat back into the flow of heated air.

This solution of thermal isolation is less cumbersome and more long-lasting than a thermal isolation for example by means of a layer of mineral fibers.

In an advantageous embodiment, the fume pipes 33 extend in a direction radial to the longitudinal axis 17 and have an elongated transversal section shape in a heater 1 longitudinal direction (direction of the air flow 10 to be heated in the thermal exchange channel 24), in particular a prismatic shape, for example hexagonal, with front and rear corners aligned in longitudinal direction which corresponds to the direction of the air flow 10.

This reduces the resistance to the air flow 10 to be heated on the one hand and compensates for and increases the thermal exchange area at the fume pipes 33 on the other.

According to a preferred embodiment, the ratio between the total area of thermal exchange, intended as the sum of the areas of the side wall 16 of the combustion chamber 14 and of the first cylindrical wall 28 of the external heating chamber 26, and the sum of the areas of the combustion space 15 and of the annular fume channel 27 in section perpendicular to the longitudinal axis 17, is greater than 10:1, preferably ranges between 10:1 and 14:1, even more preferably is approximately 12:1, while the ratio between the total area of thermal exchange and the area of the thermal exchange channel 24 in section perpendicular to the longitudinal axis 17 is greater than 25:1, preferably ranges between 30:1 and 40:1, even more preferably is about 37:1.

The aforesaid geometrical ranges are particularly advantageous from a fluid-dynamic and energy efficiency (reduction of noise and of vibrations, combustion stability, thermal exchange efficiency) point of view for configurations of heater 1 in which the cylindrical walls 16, 28, 29 of the combustion chamber 14 of the external heating chamber 26 are coaxial.

Looking in even greater geometrical detail of the preferred embodiment, tests and numeric simulations point out a high energy efficiency (combustion and thermal exchange) with reduced vibrations and noise, when:

the ratio L16/D16 of length L16 to diameter D16 of the combustion space 15 (i.e. of the side wall 16 of the combustion chamber 14) ranges between 1.8 and 2.1, preferably being about 1.95, the ratio L16/D28 of length L16 of the combustion space 15 to diameter D28 of the first cylindrical wall 28 ranges between 1.5 and 1.7, preferably being about 1.6, the ratio L16/D29 of length L16 of the combustion space 15 to diameter D29 of the second cylindrical wall 29 ranges between 1.3 and 1.5, preferably being about 1.41.

By way of non-limiting example, the aforesaid geometrical parameters can be chosen as follows (approximate values of example ranges, preferred values being identified):

Axial length L16 of the combustion chamber 14=725 mm — 875 mm, preferably 875 mm, Diameter D16 of the combustion chamber 14=400 mm — 450 mm, preferably 423 mm, Diameter D28 of the first cylindrical wall 28=490 mm — 540 mm, preferably 513 mm, Diameter D29 of the second cylindrical wall 29=560 mm — 600 mm, preferably 581 mm, When provided, diameter D46 of the heat-reflecting layer 46=590 mm — 630 mm, preferably 611 mm, Diameter D4 of the side wall 4 of housing 3=605 mm — 635 mm, preferably 621 mm.

According to an embodiment, the side wall 4 of housing 3 comprises two semi-cylindrical half-shells 53 removably screwed to each other, preferably in a substantially vertical (to reduce the side dimensions) or horizontal (to facilitate the opening of housing 3 for maintenance operations or the replacement of the burner-heat exchanger unit) screwing plane. In any case, forming the side wall 4 by means of two half-shells 53 reduces the transport and handling costs of the semi-finished sheets and the manufacturing of heater 1.

According to a further embodiment, the external heating chamber 26 comprises one or more cleaning windows 49 possibly formed in the annular front wall 30 and accessible through the fourth pathway 13 of housing 3, and being openable/closable by means of lids 50 removably fixed (e.g. by means of screws) to the external heating chamber 26 (FIG. 11). This allows an easy cleaning of the annular fume channel 27 by means of water jet.

In accordance with a further embodiment, the side wall 16 of the combustion chamber 14 and the first cylindrical wall 28 of the external heating chamber 26 each form a plurality of bosses 52 protruding radially outwards and adapted to further promote the thermal exchange in the inner and outer thermal exchange interfaces.

Those skilled in the art may make several changes and adaptations to the above-described embodiments of the heater, and may replace elements with others which are functionally equivalent in order to meet contingent needs, without thereby departing from the scope of the following claims. Each of the features described as belonging to a possible embodiment can be embodied independently of the other embodiments described.

The invention claimed is:

1. A transportable combustion air heater, comprising:

A) a transportable supporting frame,

B) a housing made of sheet steel fixed to the frame and having:

a substantially cylindrical side wall, a rear wall and a front wall opposite the rear wall, a first pathway for an inlet of combustion air and a second pathway for an inlet of ambient air to be heated which are formed in the rear wall, a third pathway formed in the side wall of the housing for an outlet of fumes and combustion gases, a fourth pathway formed in the front wall for an outlet of heated ambient air, C) a cylindrical combustion chamber made of sheet steel fixedly arranged in the housing and internally defining a combustion space, said combustion chamber having:

a cylindrical side wall concentric with a longitudinal axis of the transportable combustion air heater, a rear wall closing the combustion chamber on a rear side, and a front wall without openings that closes the combustion chamber on a front side, an inlet opening formed in the rear wall of the combustion chamber for incoming combustion air, a plurality of fume outlet openings spaced away from each other and formed in the side wall of the combustion chamber, D) a cylindrical annular thermal exchange channel formed around the combustion space and delimited by the side wall of the combustion chamber and by a first cylindrical wall outwardly extended around the side wall of the combustion chamber, the thermal exchange channel having:

a rear annular opening extended around the combustion chamber for the incoming ambient air to be heated, a front annular opening extended around the combustion chamber for outgoing heated ambient air, E) an external heating chamber made of sheet steel fixedly arranged in the housing, wherein said external heating chamber forms a cylindrical annular fume channel around the thermal exchange channel and comprises:

the first cylindrical wall and a second cylindrical wall externally extended around the first cylindrical wall, an annular front wall and an annular rear wall closing the cylindrical annular fume channel on front and rear sides, a plurality of fume inlet openings spaced from each other and formed in the first cylindrical wall, an exhaust fume opening formed in the second cylindrical wall and aligned to the third pathway in the side wall of the housing, fume pipes connecting each fume outlet opening of the combustion chamber to respectively one of the fume inlet openings of the external heating chamber for causing the combustion fumes to flow from the combustion space into the cylindrical annular fume channel, thereby keeping the fumes separated from a flow of ambient air in the thermal exchange channel, F) an exhaust fume pipe extended from the exhaust fume opening of the external heating chamber through the third pathway in the side wall of the housing for exhausting the exhausted fumes from the cylindrical annular fume channel to the outside of the transportable combustion air heater, G) an air distribution space defined by the housing and the front walls of the combustion chamber and external heating chamber, H) a first fan fixed to the rear wall of the housing at the first pathway to blow the combustion air into the combustion chamber, I) a second fan fixed to the rear wall of the housing at the second pathway to channel the ambient air to be heated through the air distribution space in the thermal exchange channel, J) an air feeding pipe extended from the first fan through the air distribution space to the inlet opening of the combustion chamber, such as to isolate a flow of the combustion air from the ambient air to be heated, K) a fuel feeder configured to feed a liquid fuel into the combustion chamber, wherein in the external heating chamber, one or more guide walls transversal to the first and second cylindrical wall are arranged that lengthen fume flow paths in the annular fumes channel from the fume inlet openings to the exhaust fume opening.

2. The transportable combustion air heater according to claim 1, wherein the one or more guide walls comprise windows causing a portion of the fumes to flow directly through the one or more guide walls.

3. The transportable combustion air heater according to claim 1, wherein the one or more guide walls comprise:

a first group of guide walls spaced away from each other in a circumferential direction relative to the longitudinal axis and running in a longitudinal direction from a front end of the cylindrical annular fume channel towards an opposite rear end thereof, and a second group of guide walls spaced away from each other in a circumferential direction relative to the longitudinal axis and running in a longitudinal direction from the rear end of the cylindrical annular fume channel towards the front end thereof, wherein the guide walls of the first group overlap or alternate with the guide walls of the second group, defining a fumes flow path having an undulated shape from the fume inlet openings to the exhaust fume opening.

4. The transportable combustion air heater according to claim 2, wherein the one or more guide walls have an axial length (L43) ranging from 60% to 80% of a total axial length (L27) of the cylindrical annular fume channel, and an axial length (L44) of the windows ranges from 40% to 60% of the axial length (L43) of the corresponding guide wall.

5. The transportable combustion air heater according to claim 1, wherein the plurality of fume inlet openings are formed in an area circumferentially opposite to an area where the exhaust fume opening is formed and the guide walls are arranged between the fume inlet and exhaust fume openings in such a manner to define a path having two opposite bends between said openings.

6. The transportable combustion air heater according to claim 1, wherein:

a sum of opening section areas of the plurality of fume outlet openings is comprised between 1/40 and 1/60of a total area of the side wall of the combustion chamber, and each opening section area of an individual fume outlet opening is less than 75 $cm^2$.

7. The transportable combustion air heater according to claim 1, comprising:

a layer made of aluminized sheet, formed around the second cylindrical wall of the external heating chamber such as to provide a thermal isolation barrier, an annular interstice formed between the second cylindrical wall and the side wall of the housing, through which annular interstice a cooling flow is passed which is separated from the flow of ambient air, such as to realize a cooling barrier.

8. The transportable combustion air heater according to claim 1, wherein the fume pipes extend in a direction radial to the longitudinal axis and have an elongated transversal section shape in a heater longitudinal direction, wherein a ratio between a sum of areas of the side wall of the combustion chamber and of the first cylindrical wall and a sum of section areas of the combustion space and of the cylindrical annular fume channel in a section plane perpendicular to the longitudinal axis is greater than 10:1, and wherein a ratio of the sum of areas of the side wall of the combustion chamber and the first cylindrical wall and a section area of the thermal exchange channel in a section plane perpendicular to the longitudinal axis is greater than 25:1.

9. The transportable combustion air heater according to claim 1, wherein:

a first ratio (L16/D16) of a length (L16) to a diameter (D16) of the combustion space ranges between 1.8 and 2.1, a second ratio (L16/D28) of the length (L16) of the combustion space to a diameter (D28) of the first cylindrical wall ranges between 1.5 and 1.7, and a third ratio (L16/D29) of the length (L16) of the combustion space to a diameter (D29) of the second cylindrical wall ranges between 1.3 and 1.5.

10. The transportable combustion air heater according to claim 1, wherein said side wall of the housing comprises two semi-cylindrical half-shells removably screwed to each other.

11. The transportable combustion air heater according to claim 1, wherein the external heating chamber comprises one or more cleaning windows formed in the annular front wall and accessible through the fourth pathway of the housing, said cleaning windows being closable by means of lids removably fixed to the external heating chamber.

* * * * *